US008653723B2

(12) United States Patent
Cao et al.

(10) Patent No.: US 8,653,723 B2
(45) Date of Patent: Feb. 18, 2014

(54) LED LIGHT BULBS FOR SPACE LIGHTING

(75) Inventors: Densen Cao, Sandy, UT (US); Zhaohui Lin, Salt Lake City, UT (US)

(73) Assignee: CAO Group, Inc., West Jordan, UT (US)

( * ) Notice: Subject to any disclaimer, the term of this patent is extended or adjusted under 35 U.S.C. 154(b) by 0 days.

(21) Appl. No.: 12/706,869

(22) Filed: Feb. 17, 2010

(65) Prior Publication Data

US 2010/0207502 A1 Aug. 19, 2010

Related U.S. Application Data

(60) Provisional application No. 61/207,751, filed on Feb. 17, 2009.

(51) Int. Cl.
*H01J 1/02* (2006.01)
*H01J 7/24* (2006.01)

(52) U.S. Cl.
USPC ..... 313/46; 313/45; 362/294; 362/800

(58) Field of Classification Search
USPC ..... 313/46, 45; 362/218, 294, 800, 311.02
See application file for complete search history.

(56) References Cited

U.S. PATENT DOCUMENTS

| | | | |
|---|---|---|---|
| 1,151,377 | A | 8/1915 | Nash |
| 4,240,090 | A | 12/1980 | Hughes |
| 4,394,679 | A | 7/1983 | Hawrylo |
| 4,674,011 | A | 6/1987 | Patton |
| 4,675,575 | A | 6/1987 | Smith |
| 4,727,289 | A | 2/1988 | Uchida |
| 5,055,892 | A | 10/1991 | Gardner |
| 5,160,200 | A | 11/1992 | Cheselske |
| 5,174,646 | A | 12/1992 | Siminovitch |
| 5,349,599 | A | 9/1994 | Larkins |
| 5,414,281 | A | 5/1995 | Watabe |
| 5,463,280 | A | 10/1995 | Johnson |
| 5,535,230 | A | 7/1996 | Abe |
| 5,575,459 | A | 11/1996 | Anderson |
| 5,595,438 | A | 1/1997 | Burd |
| 5,655,830 | A | 8/1997 | Ruskouski |
| 5,688,042 | A | 11/1997 | Madadi |
| 5,707,139 | A | 1/1998 | Haitz |
| 5,721,430 | A | 2/1998 | Wong |
| 5,758,951 | A | 6/1998 | Haitz |
| 5,765,940 | A | 6/1998 | Levy |
| 5,803,579 | A | 9/1998 | Turnbull |
| 5,806,965 | A | 9/1998 | Deese |
| 5,813,752 | A | 9/1998 | Singer |
| 5,890,794 | A | 4/1999 | Abtahi |
| 5,941,626 | A | 8/1999 | Yamuro |

(Continued)

OTHER PUBLICATIONS

US Pending Patent Application, U.S. Appl. No. 12/785,203, Office Action dated Nov. 2, 2010.

(Continued)

*Primary Examiner* — Joseph L Williams
(74) *Attorney, Agent, or Firm* — CAO Group, Inc.

(57) ABSTRACT

The invention discloses a three dimensional LED arrangement and heat management method using a heat transfer or conduction pipe to enable rapid heat transfer from a three dimensional cluster of LEDs to a heatsink with or without active cooling, the light emitted from the three dimensional cluster not being obstructed by a heat sink arrangement such that the light beam profile generated by the light appears similar to that generated by traditional incandescent bulbs.

22 Claims, 7 Drawing Sheets

(56) References Cited

U.S. PATENT DOCUMENTS

| | | | | |
|---|---|---|---|---|
| 5,941,631 | A | 8/1999 | Hsu | |
| 5,947,588 | A | 9/1999 | Huang | |
| 5,982,092 | A | 11/1999 | Chen | |
| 6,015,979 | A | 1/2000 | Sugiura | |
| 6,045,240 | A | 4/2000 | Hochstein | |
| 6,149,283 | A | 11/2000 | Conway | |
| 6,220,722 | B1 | 4/2001 | Begemann | |
| 6,238,077 | B1 | 5/2001 | Ramer | |
| 6,355,946 | B1 | 3/2002 | Ishinaga | |
| 6,357,889 | B1 | 3/2002 | Duggal | |
| 6,402,338 | B1 | 6/2002 | Mitzel | |
| 6,412,971 | B1 | 7/2002 | Wojnarowski | |
| 6,478,453 | B2 | 11/2002 | Lammers | |
| 6,499,860 | B2 | 12/2002 | Begemann | |
| 6,502,952 | B1 | 1/2003 | Hartley | |
| 6,504,180 | B1 | 1/2003 | Hermans | |
| 6,541,800 | B2 | 4/2003 | Barnett | |
| 6,561,680 | B1 | 5/2003 | Shih | |
| 6,577,073 | B2 | 6/2003 | Shimizu | |
| 6,580,228 | B1 | 6/2003 | Chen | |
| 6,601,962 | B1 | 8/2003 | Ehara | |
| 6,635,987 | B1 | 10/2003 | Wojnarowski | |
| 6,709,132 | B2 | 3/2004 | Ishibashi | |
| 6,715,900 | B2 | 4/2004 | Zhang | |
| 6,786,625 | B2 | 9/2004 | Wesson | |
| 6,815,241 | B2 | 11/2004 | Wang | |
| 6,840,654 | B2 | 1/2005 | Guerrieri | |
| 6,903,380 | B2 | 6/2005 | Barnett | |
| 6,948,829 | B2 | 9/2005 | Verdes | |
| 6,974,233 | B1 | 12/2005 | Aubrey | |
| 6,982,518 | B2 | 1/2006 | Chou | |
| 7,128,454 | B2 | 10/2006 | Kim | |
| 7,150,553 | B2 | 12/2006 | English | |
| 7,196,358 | B1 | 3/2007 | Chen | |
| 7,434,964 | B1 * | 10/2008 | Zheng et al. | 362/294 |
| 7,490,959 | B2 | 2/2009 | Tsuda | |
| 7,588,351 | B2 | 9/2009 | Meyer | |
| 7,726,858 | B2 | 6/2010 | Sato | |
| 2002/0113244 | A1 | 8/2002 | Barnett | |
| 2003/0031032 | A1 | 2/2003 | Wu | |
| 2003/0117797 | A1 | 6/2003 | Sommers | |
| 2004/0095738 | A1 | 5/2004 | Juang | |
| 2004/0201025 | A1 | 10/2004 | Barnett | |
| 2004/0264196 | A1 | 12/2004 | Shu | |
| 2005/0007772 | A1 | 1/2005 | Yen | |
| 2005/0174780 | A1 | 8/2005 | Park | |
| 2005/0194607 | A1 | 9/2005 | Barnett | |
| 2005/0243550 | A1 | 11/2005 | Stekelenburg | |
| 2005/0254246 | A1 | 11/2005 | Huang | |
| 2006/0138440 | A1 | 6/2006 | Jyo | |
| 2006/0232974 | A1 | 10/2006 | Lee | |
| 2007/0236935 | A1 | 10/2007 | Wang | |
| 2007/0253202 | A1 | 11/2007 | Wu | |
| 2007/0273299 | A1 * | 11/2007 | Miskin et al. | 315/250 |
| 2008/0013316 | A1 * | 1/2008 | Chiang | 362/264 |
| 2008/0105886 | A1 | 5/2008 | Borner | |
| 2008/0197374 | A1 | 8/2008 | Sung | |
| 2008/0247177 | A1 * | 10/2008 | Tanaka et al. | 362/373 |
| 2008/0253125 | A1 * | 10/2008 | Kang et al. | 362/294 |
| 2009/0021944 | A1 * | 1/2009 | Lee et al. | 362/294 |
| 2009/0046464 | A1 * | 2/2009 | Liu et al. | 362/294 |
| 2010/0033071 | A1 * | 2/2010 | Heffington et al. | 313/46 |
| 2011/0168247 | A1 * | 7/2011 | Guha et al. | 136/255 |

OTHER PUBLICATIONS

US Pending Patent Application, U.S. Appl. No. 11/938,131, Office Action dated Mar. 11, 2010.

US Pending Patent Application, U.S. Appl. No. 12/296,274, Office Action dated Jan. 6, 2011.

US Pending Patent Application, U.S. Appl. No. 11/938,131, Office Action dated Nov. 26, 2010.

PCT Application, Serial No. PCT/US2007/065995, Written Opinion of the International Searching Authority, Jun. 20, 2008.

* cited by examiner

LED LIGHT BULBS FOR SPACE LIGHTING

CROSS-REFERENCE TO RELATED APPLICATIONS

This application claims the benefit of U.S. Provisional Application, Ser. No. 61/207,751, filed on Feb. 17, 2009, the disclosure of which is incorporated herein by reference.

TECHNICAL FIELD OF THE INVENTION

The present invention relates to the field of LED lighting and, more particularly, to concentrated LED lighting devices that transfer heat quickly to a separate heat sink with or without active cooling to dissipate the heat away from the concentrated LED light source.

BACKGROUND OF THE INVENTION

Light emitting diodes (LEDs) are considered an efficient light source to replace incandescent, compact fluorescent lights (CFLs) and other more conventional light sources to save electrical energy. LEDs use significantly less than the energy required by incandescent lights to produce comparable amounts of light. The energy savings ranges from 40 to 80% depending on the design of light bulbs. In addition, LEDs contain no environmental harming elements, such as mercury that is commonly used in CFLs. Light bulbs using LEDs as the light source for replacing traditional incandescent bulbs, CFLs and other conventional sources are required to produce the same as or better quantities and qualities of light. The quantity of the light depends on light output, which can be increased with increasing LED efficiency, number or size, as well as electronic driver efficiency. The quality of the light is related to factors affecting the color rendering index and the light beam profile. Since most packaged LED devices do not emit light omni-directionally, a challenge exists when designing replacement bulbs using packaged LEDs that do emit light omni-directionally. On the other hand, LEDs emitting in one direction can be easily adopted for down lighting as is done with MR16 lights with heat management systems and an electronic driver. However, in order to radiate light spatially using LEDs—i.e., in a non-unidirectional or omni-directional fashion similar to that provided using incandescent bulbs—a special three-dimensional positioning arrangement for multiple LEDs is generally required. Various embodiments of spatial, radial or otherwise non-unidirectional lighting using LEDs have been described in the prior art, with examples being found in: U.S. Pat. No. 6,634,770 (Cao); U.S. Pat. No. 6,634, 771 (Cao); U.S. Pat. No. 6,465, 961 (Cao); U.S. Pat. No. 6,719,446 (Cao) issued Apr. 13, 2004. Various further examples can be found in co-owned and pending U.S. patent applications, having Ser. Nos.: 11/397, 323; 11/444,166 and 11/938,131. The above mentioned prior art provides solutions that create light beam profiles similar to those produced by incandescent light bulbs. The disclosures of the foregoing issued patents and applications are incorporated herein by reference. The invention described below advances the prior art devices through inventive means of advantageously transferring heat energy away from the LED lighting device to a separate heat sink to dissipate the heat away from the LED light source. The invention thus helps to improve heat management and light beam profiles in LED-based lighting.

SUMMARY OF THE INVENTION

The invention discloses a 3 dimensional LED arrangement and heat management method using a heat transfer pipe to enable the heat transferred quickly from a 3 dimensional cluster of LEDs to a heatsink with/without active cooling. The light emitted from the 3 dimensional cluster is not obstructed by any heat sink arrangement so that the light beam profile can be similar to traditional incandescent bulbs.

DETAILED DESCRIPTION OF THE INVENTION

Figure 1:
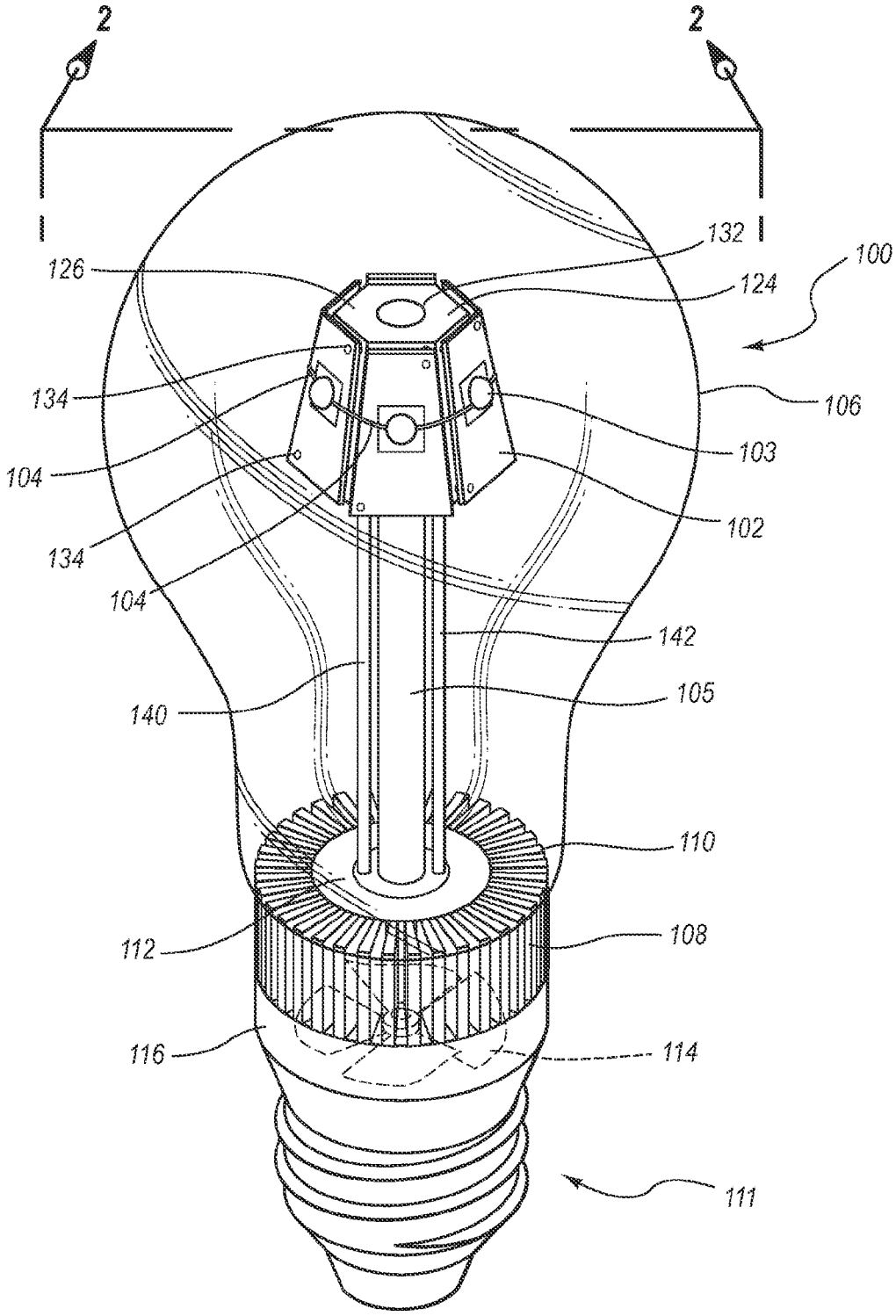
FIG. 1 provides a perspective view of one embodiment of an LED lighting device according to the present invention.
Figure 2:
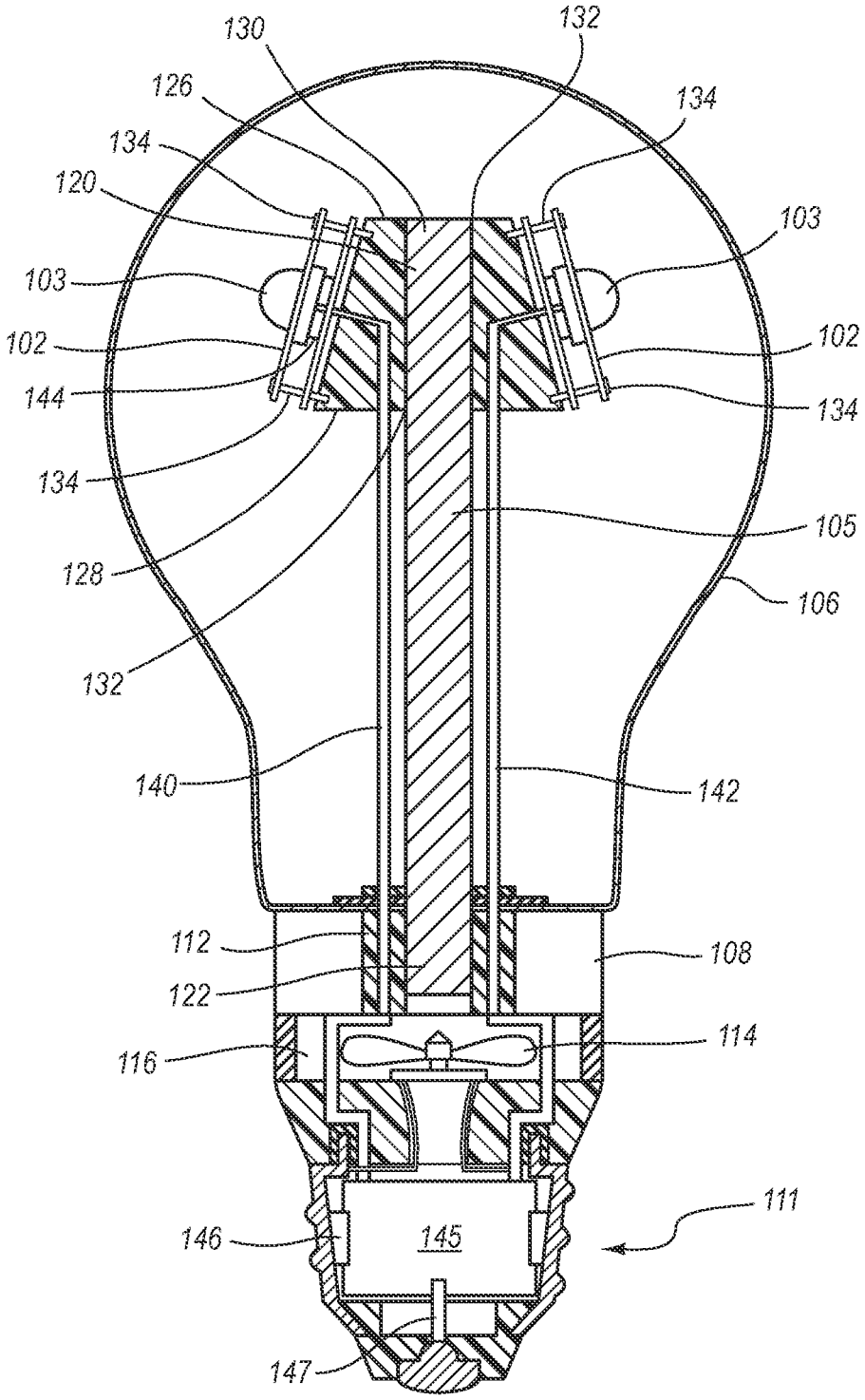
FIG. 2 provides a cross sectional view of the LED lighting device illustrated in FIG. 1.

Referring to FIGS. 1 and 2, an embodiment of the present invention is illustrated depicting an LED lighting device 100 having a plurality of panels 102 and LEDs 103 mounted to the panels 102 and advantageously arranged about a central axis for space lighting—i.e., lighting in a non-unidirectional fashion similar to that provided using incandescent bulbs. Illumination from the lighting device 100 is provided by the plurality of LEDs 103. A glass or plastic bulb (or transparent housing) 106 encases the LEDs and the various components that incorporate the assembled lighting device 100 and is sized such that the bulb 106 appears like a traditional light bulb. If desired, the bulb can be frosted, colored or transparent, which further permits the lighting device 100 to appear as a traditional light source.

The panels 102, in one embodiment, are mounted to a multi-faceted frame 124. A heat conduction pipe 105 extends substantially along the central axis referred to above and includes a proximal end 120 and a distal end 122. Generally speaking, the heat conduction pipe refers to any structure or material capable of conducting heat from high to low temperature. The frame 124 is secured to the proximal end 120 of the heat conduction pipe 105. The frame 124 has an upper 126 and lower 128 surface with holes 132 extending through the surfaces for mounting the frame 124 to a rod-like 130 portion of the heat conduction pipe 105. The frame 124 can be secured to the heat conduction pipe 105 using a tight friction-fit or a heat conductive paste between the outer surface of the pipe 105 and the inner surface of the holes 132 or using suitable adhesives or fasteners.

Further, the frame 124 can be solid or hollow, depending on the heat load or weight requirements. For a relatively light-weight lighting device, for example, the frame 124 is advantageously constructed from metal sheet stock—e.g., aluminum or any other heat conducting material—and constructed using fold lines positioned on the sheet stock to yield the desired three-dimensional multifaceted shape or design. On the other hand, for a relatively heavier lighting device, the frame can be constructed using a slug of metal or any other heat conducting material, the slug being cast or machined or otherwise molded into the desired multifaceted shape or design. Embodiments employing the hollow design may include heat conducting means—e.g., rods or fins—connecting the frame 124 to the heat conducting pipe 105 for enhanced transfer of heat from the frame to the pipe. The facets of the frame 124 can be vertical or angel positively or negatively, depending upon the desired light beam profile of the lighting device 100 and the emitting patterns of the component LEDs.

As further indicated in FIGS. 1 and 2, the plurality of panels 102 and LEDs 103 are secured to one or more of the faces of the multi-faceted frame 124. In one embodiment, pairs of screws 134 secure corresponding panels 102 to each face of the frame 124. The light emitting portion of each LED 103 extends through a hole in the panel 102 while the backside of the LED is attached to either the panel 102 or the face of the frame or both using a heat conductive paste 144. In one embodiment, the LEDs 103 are wired in series by connecting corresponding positive and negative leads from each LED 103 using wires 104. The LEDs can also be connected using combinations of serial and parallel circuitry depending on the components used and the requirements of the electronic driver. A pair of power conducting wires 140, 142 supply power to the LEDs 103 from an electronic driver 145. The electronic driver 145 is used to convert AC input to DC output that is generally required to drive LED circuitry, electrically isolate various components of the device from one another and to control operation of the LEDs—e.g., control dimming. The electronic driver 145 is positioned inside a standard Edison base 111 of the lighting device 100 and connected to the Edison base which generally receives AC power through conducting leads 246, 247. However, if the LEDs on the frame 124 can be driven directly by AC power, then the electronic driver 145 is not required in the embodiment. The threaded base portion generally comprises the components and sizes associated with a standard Edison screw base—e.g., size E27, and ranging from E5 to E40; while threaded base portions are generally preferred for connection with an external supply of power, other means of connection—e.g., pins or prongs—are considered within the scope of the invention. Surface mounted LEDs are generally preferred for the foregoing embodiment, and those skilled in the art will appreciate that while the above description refers to wiring the LEDs in series, the LEDs are also readily wired in parallel or using combinations of series and parallel circuitry.

Still referring to FIGS. 1 and 2, the distal end 122 of the heat conduction pipe 105 extends into a heat sink 108. The heat sink 108 is illustrated having fins 110 for dissipation of heat, although rods or other configurations of heat dissipations means may be used. The fins 110 extend from a heat conducting slug 112 that conducts heat away from the distal end of the heat conduction tube 105 and to the fins 110. In one embodiment, a fan assembly 114 is positioned below the heat sink 108 and directs a flow of cooling air past the fins 110 of the heat sink 108. The bulb 106 may be completely sealed, as illustrated in FIG. 2. In such case, the flow of cooling air is directed through the fins 110 and about the outer surface of the bulb 106. Alternatively, the bulb 106 may include an opening adjacent the fins 110, in which case the flow of cooling air is directed past the fins 110 and into the interior of the bulb 106. Referring to embodiments where a fan 114 is used, a storage space 116 is incorporated into the lighting device 100, typically above the threaded base portion 111 and the below the heat sink 108.

Figure 3:
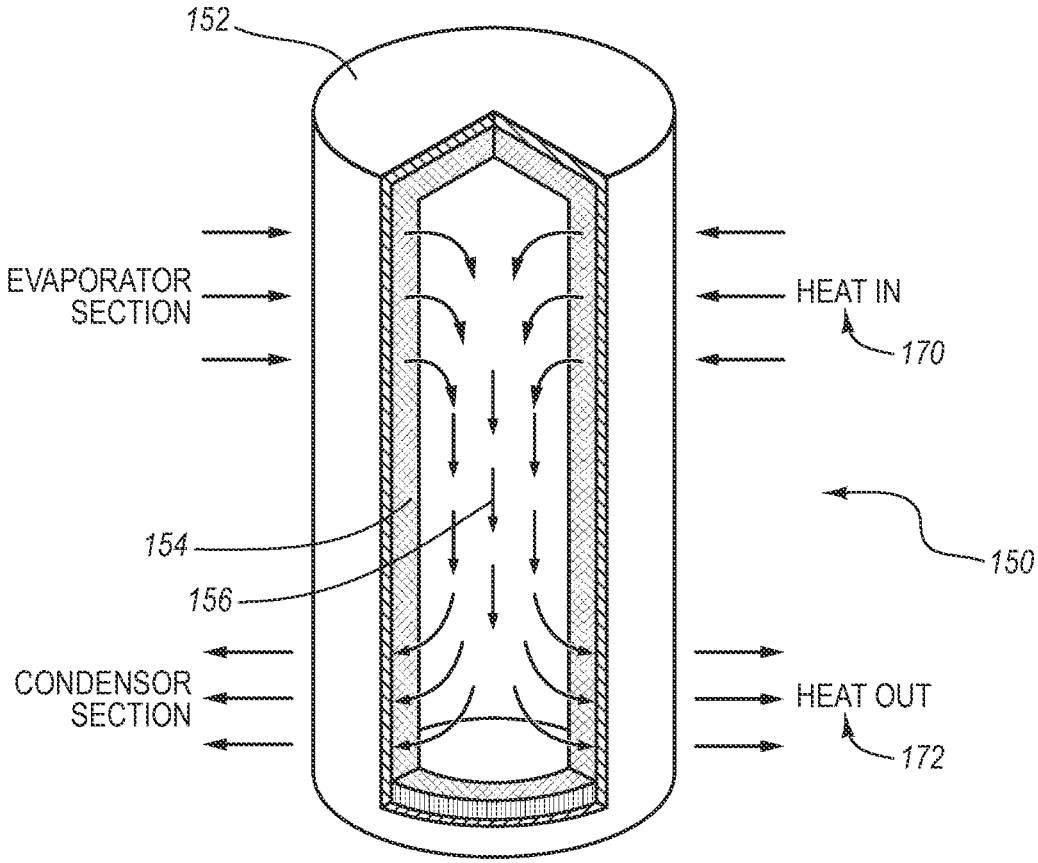
FIG. 3 provides a cross sectional view of one embodiment of a heat pipe as used in the present invention.

Referring to FIG. 3, in one embodiment, a heat conduction pipe 150 for use with the present invention includes a sealed cylindrical tube 152, a wicking structure 154, a working fluid within the wicking structure 152 and a hollow space 156 interior to the wicking structure 154. Application of heat at a proximal end 170 of the heat conduction pipe 150 causes the working fluid at that point to evaporate to the gaseous state, picking up the latent heat of vaporization. The gas, which then has a higher pressure, travels along the hollow space 156 toward the cooler distal end 172 where it condenses back to the liquid state, releasing the latent heat of vaporization to the distal end 172 of the heat conduction pipe 150. The condensed working fluid then travels back along the wicking structure 152 toward the proximal end 170 and repeats the process.

In an alternative embodiment the heat conducting pipe may include an interior section housing an interior solid material having a melting point below that of the material used to construct the heat pipe. In such case, the latent heat of melting of the interior material may be used to store a portion of the heat generated by the LEDs as the interior material changes phase from a solid to a liquid: In one embodiment, for example, the heat conduction pipe is constructed of aluminum or copper and houses an interior material comprising tin or lead, both of which exhibit melting points substantially below that of both copper and aluminum. Gallium may also be used as a suitable metal for the interior material. A still further alternative is to substitute a solid rod, constructed using materials having good heat conduction properties, e.g. aluminum or copper, for the more conventional heat conduction pipes described above.

In one embodiment, the heat conduction pipe is a cylindrical rod between about two (2) and about three (3) inches in length and between about one-quarter (¼) and about three-quarters (¾) inch in diameter and constructed of copper; the heat sink 108, including the heat slug 112, is between about one-half (½) and about one (1) inch in diameter and between about one-quarter (¼) and about one (1) inch in thickness and constructed of aluminum; and the frame is a six-sided hexagon-shaped hollow frame constructed of aluminum sheet, having an average diameter between about one-half (½) and about one (1) inch, a length between about one-quarter (¼) and about one (1) inch and a sheet thickness of between about one thirty-second (1/32) and about one quarter (¼) inch. The shape of the bulb 106 approximates the shape of a standard 100 W incandescent bulb having a standard E27 Edison screw base.

Figure 4:
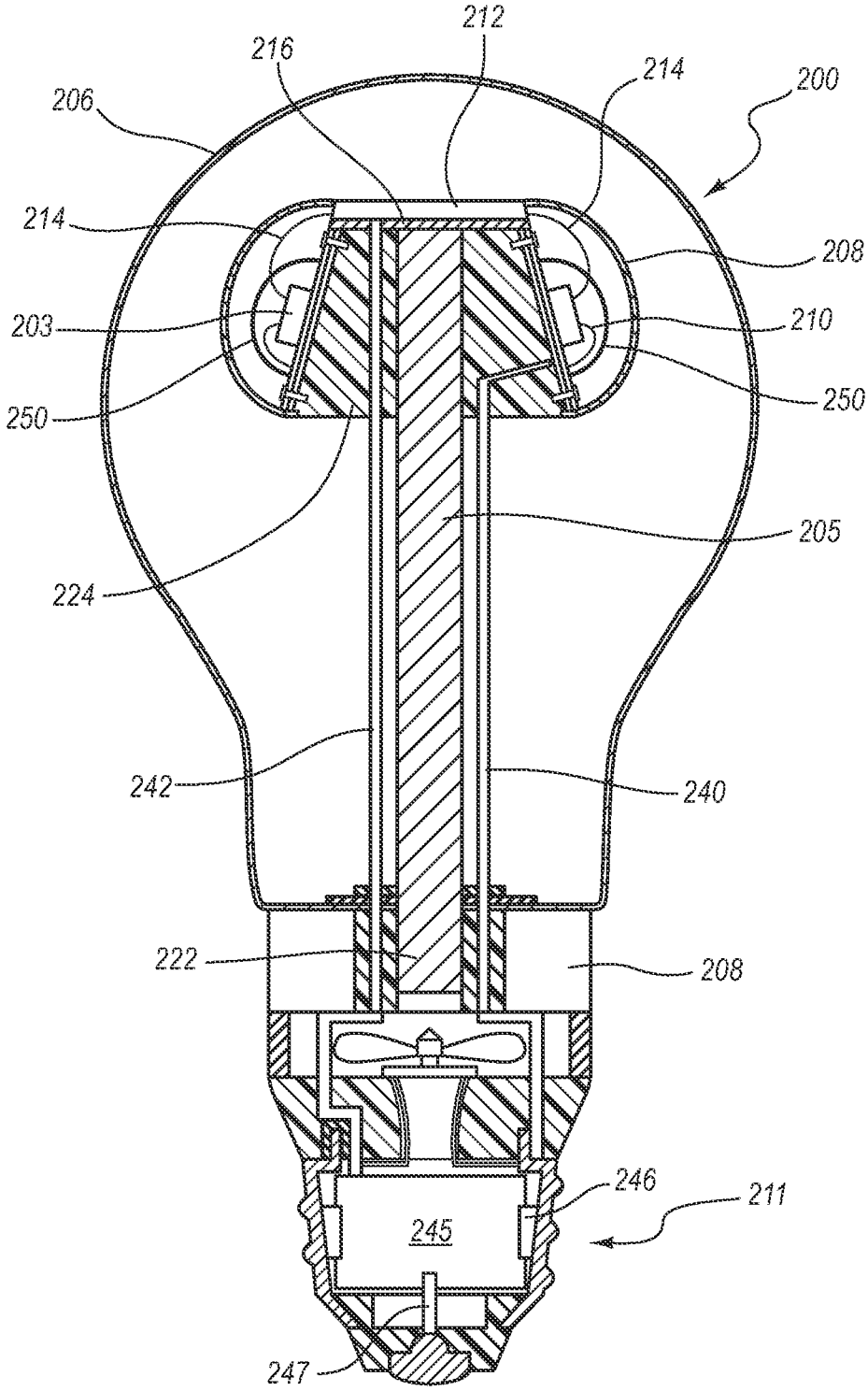
FIG. 4 provides a cross section view of a second embodiment of an LED lighting device according to the present invention.

Referring now to FIG. 4, another embodiment of the present invention is illustrated. An LED lighting device 200 includes a plurality of LED chips 203 that are mounted to a multi-faceted frame 224 and advantageously arranged about a central axis for space lighting. Illumination from the lighting device 200 is provided by the plurality of LED chips 203. This lighting configuration is similar to that discussed above regarding FIGS. 1 and 2, with the exception that the lighting in the current embodiment is provided by LED chips mounted on the multi-faceted lead frame 224, rather than surface mounted LEDs. Various exemplar chips suitable for use with the present invention are disclosed in U.S. Pat. No. 6,719,446 (Cao), the disclosures of which were previously incorporated by reference. As illustrated in the figure, the LED chips 203 are mounted directly to the multi-faceted frame 224. Suitable adhesives, such as epoxy, may be used to mount each chip to the frame 224. A glass or plastic bulb 206 encases the LED chips and frame 224 and, as detailed below, the various components that incorporate the assembled lighting device 200.

If desired, an optional layer of phosphor 250 encases one or more of the LED chips 203. The layer of phosphor is advantageous in that it, for example, in one embodiment, produces a white light or the appearance of a white light—e.g., by using an ultraviolet LED chip to stimulate a white-emitting phosphor or by using a blue LED chip to stimulate a yellow-emitting phosphor, the yellow light stimulating the red and green receptors of the eye, with the resulting mix of red, green and blue providing the appearance of white light. In one embodiment, white light or the appearance thereof is produced through use of a plurality of 450-470 nm blue gallium nitride LED chips covered by a layer of yellowish phosphor of cerium doped yttrium aluminum garnet crystals.

The LED chips are electrically connected within the lighting device 200, in one embodiment, by connecting a negative terminal of each chip to the frame 224 using a first wire 210 and by connecting a positive terminal of each chip to an electrically conducting cap 212 using a second wire 214. The electrically conducting cap 212 is positioned atop the frame 224 and electrically insulated therefrom by an insulation layer 216, which can be constructed using epoxy, AlO or any other material having electrically insulating properties. A pair of electrical conducting wires 240, 242 supply power to the LED chips 203 from a standard threaded base portion 211 of the bulb device 200. The pair of power supply wires 240, 242 extend, respectively, from corresponding contacts at the base portion 211 to the electronic driver 245 inside. Similar to that described above, the electronic driver 245 is used to covert AC input to DC output that is generally required to drive LED circuitry, electrically isolate various components of the device from one another and control operation of the LEDs—e.g., control dimming. The electronic driver 245 is positioned inside a standard Edison base 211 of the lighting device 200 and connected to the Edison base which generally receives AC power through conducting leads 246, 247. However, if the LEDs on the frame 224 can be driven directly by AC power, then the electronic driver 245 is not required in the embodiment. In this sense, the LED chips 203 are wired in parallel. As discussed in reference to the previous embodiment, however, series-wired counterparts to that disclosed in this embodiment are readily apparent to those skilled in the art and are considered within the scope of the present invention. If desired, an epoxy cap 208 is used to cover the frame 224, first and second wires 210, 214, LED chips 203 and phosphor layer 250, among other components of the lighting device. The epoxy cap 208 acts as an optical lens and also as a protection layer for the various identified components.

Still referring to FIG. 4, a heat conduction pipe 205 extends substantially along a central axis of the lighting device 200 and includes a proximal end 220 and a distal end 222. The frame 224 is secured to the proximal end 220 of the heat conduction pipe 205 in a manner similar to that described above with the previous embodiments. Likewise, the distal end 222 of the heat conduction pipe 205 extends into a heat sink 208 that is constructed and positioned similar to that described above with the previous embodiments. The various embodiments of the heat conducting pipe and heat sink discussed above, including the means of cooling the same, apply equally to the embodiments just described with reference to FIGS. 1 and 2.

Figure 5:
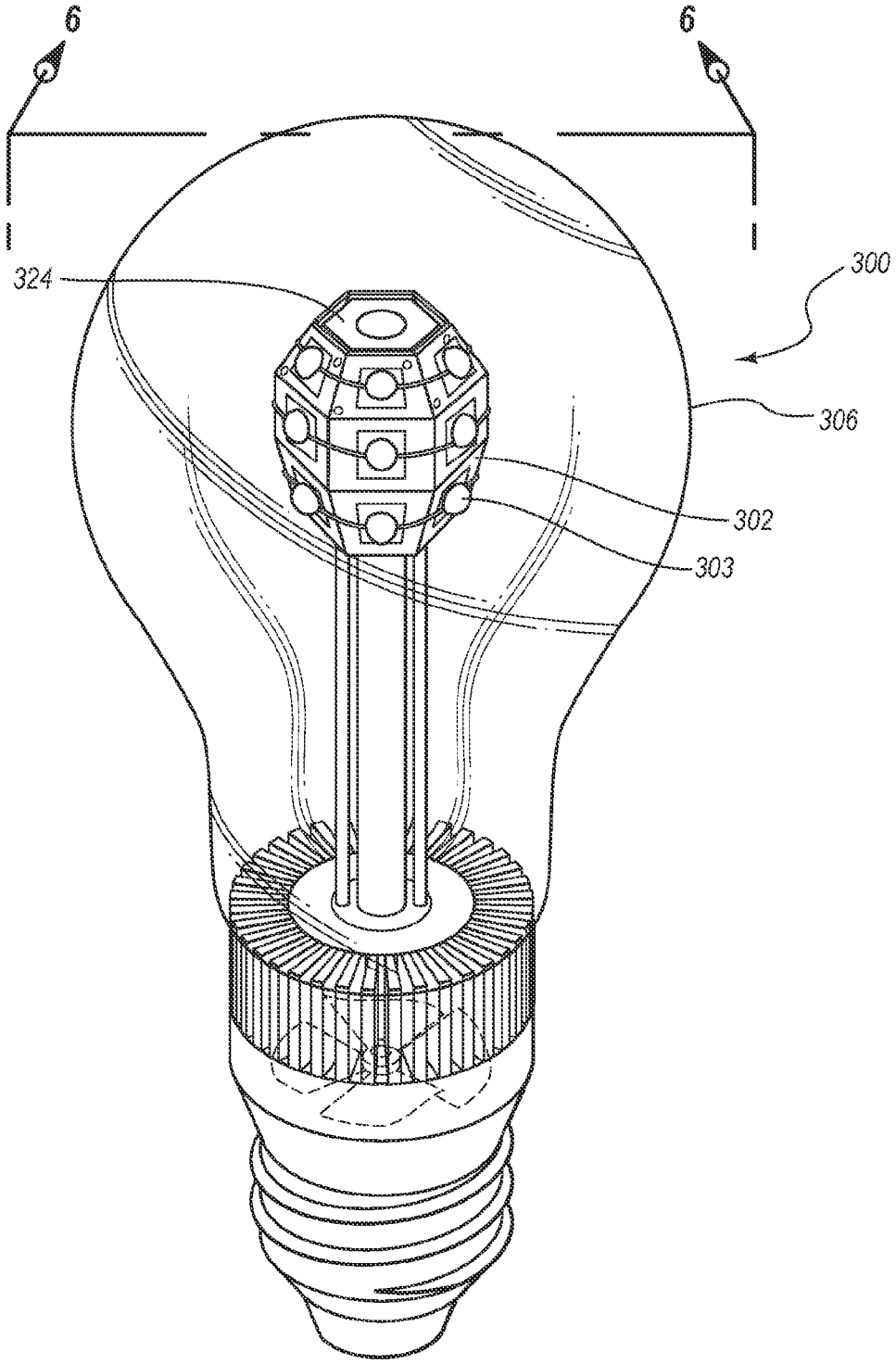
FIG. 5 provides a perspective view of a yet further embodiment of an LED lighting device according to the present invention.
Figure 6:
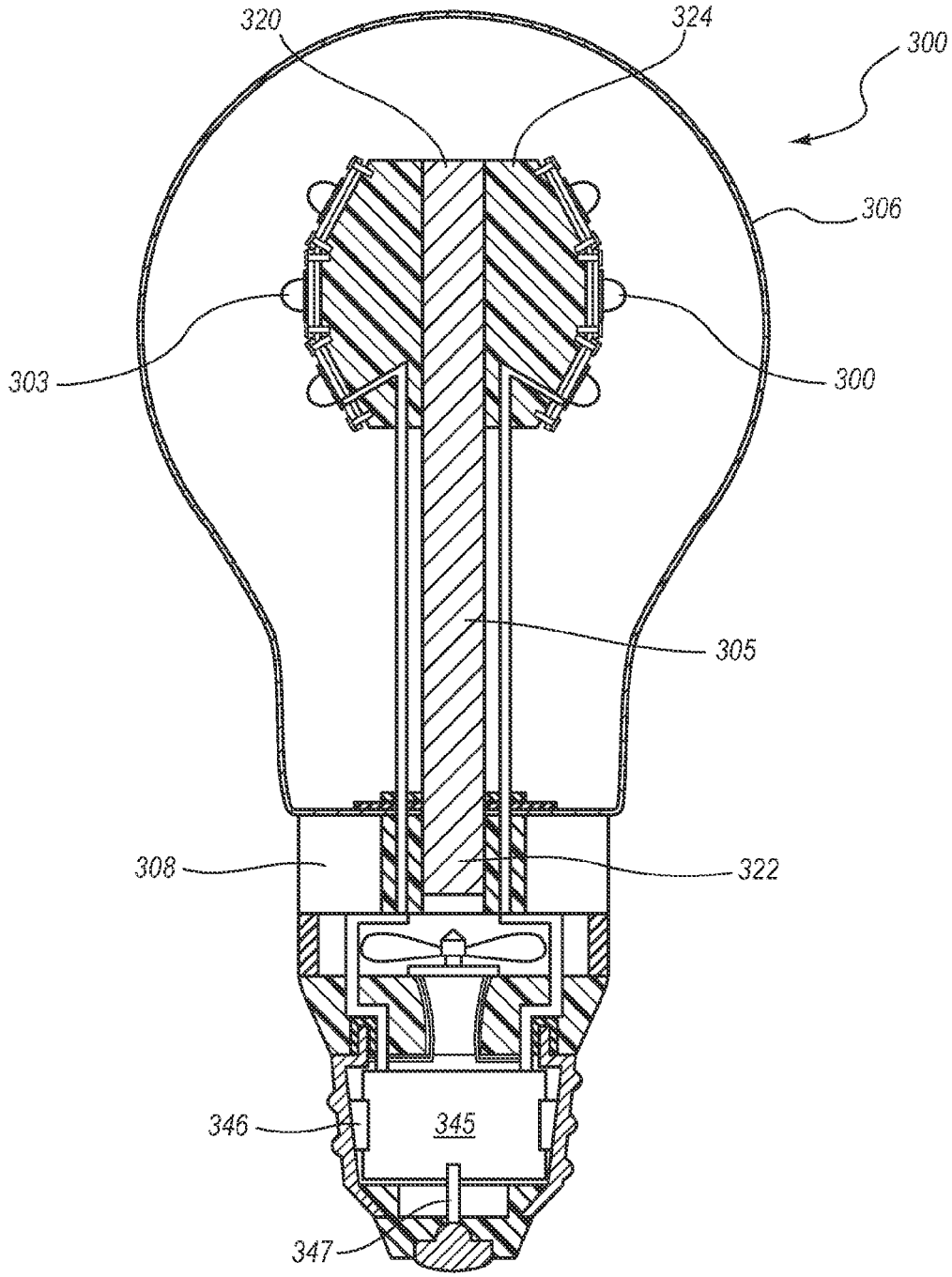
FIG. 6 provides a cross sectional view of the LED lighting device illustrated in FIG. 5.

Referring now to FIGS. 5 and 6, a still further embodiment of the present invention is disclosed. An LED lighting device 300 has a plurality of panels 302 and LEDs 303 mounted to the panels 302 and advantageously arranged about a central axis for space lighting. Illumination from the lighting device 300 is provided by the plurality of LEDs 303. A glass or plastic bulb 306 encases the LEDs and, as detailed below, the various components that incorporate the assembled lighting device 300. The panels 302, in one embodiment, are mounted to a multi-faceted frame 324, which can be constructed as described with respect to the embodiments referred to above. More particularly, the shape of the frame 324 in this embodiment approximates a sphere, such that vectors pointing outwardly normal from each face sweep in both longitudinal and latitudinal directions with respect to the sphere approximated by the frame, thereby producing a higher degree of omnidirectional special lighting—i.e., a closer approximation to light emanating outward in a spherical direction, with the greater the number of faces in the longitudinal and latitudinal directions, the better the approximation.

A heat conduction pipe 305 extends substantially along a central axis of the lighting device 300 and includes a proximal end 320 and a distal end 322. The frame 324 is secured to the proximal end 320 of the heat conduction pipe 305 in a manner similar to that described above with the previous embodiments. Likewise, the distal end 322 of the heat conduction pipe 305 extends into a heat sink 308 that is constructed and positioned similar to that described above with the previous embodiments. The various embodiments of the heat conducting pipe and heat sink discussed above, including the means of cooling the same, apply equally to the embodiments described above. Further, it is noted that the various embodiments concerning the use of surface mounted LEDs and LED chips, including the manner of wiring in series or parallel, the optional use of phosphors or epoxy coverings and the optional use of a cooling fan, may be used with or incorporated into the embodiments depicted in FIGS. 5 and 6.

Figure 7:
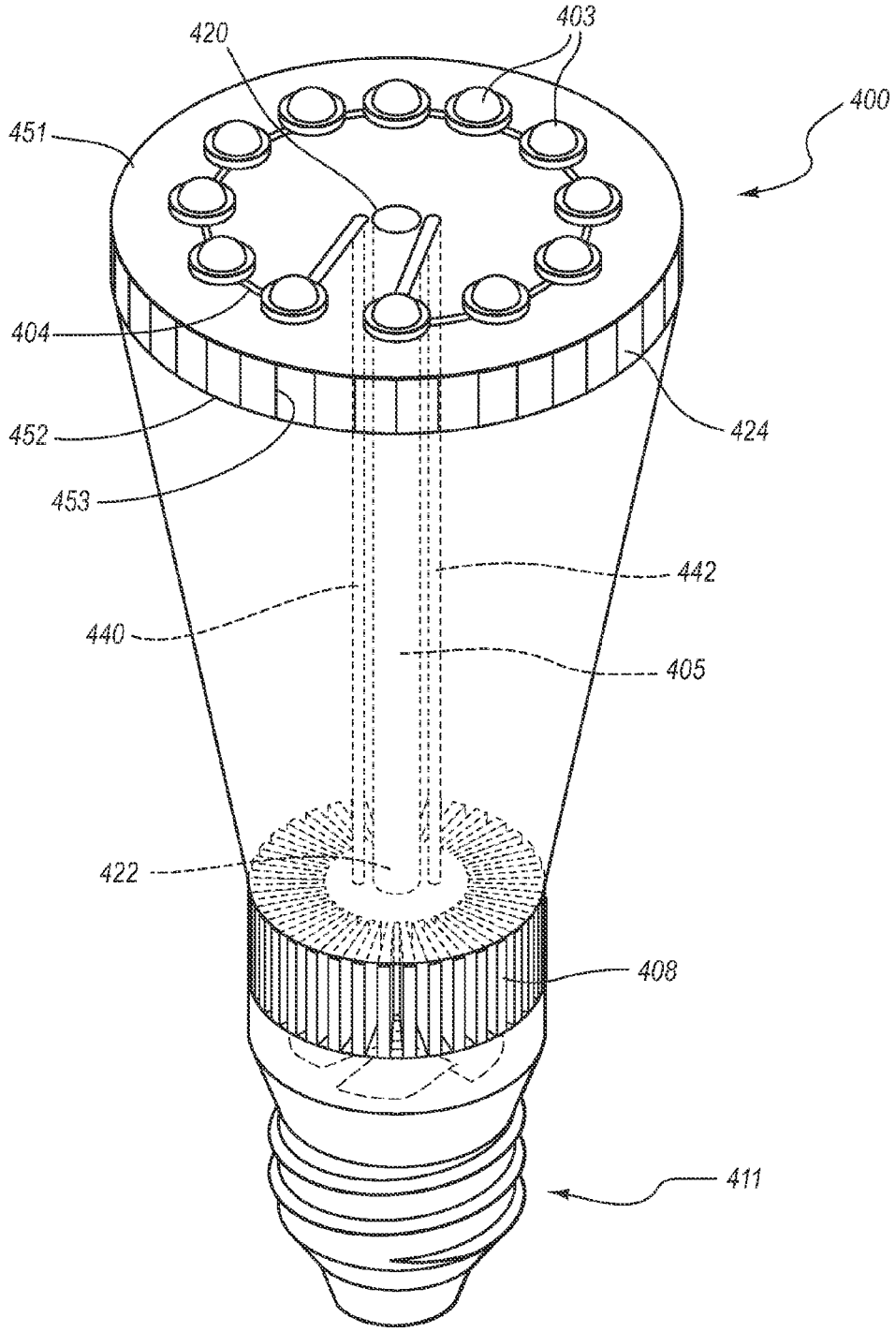
FIG. 7 provides a cross sectional view of yet another embodiment of an LED lighting device according to the present invention.

Referring now to FIG. 7, a still further embodiment of the present invention is illustrated and disclosed. An LED lighting device 400 includes a first heat sink in the form of a disk-shaped frame 424 and a plurality of LEDs 403 mounted to the frame 424 and advantageously arranged about the frame for directional space lighting. Illumination from the lighting device 400 is provided by the plurality of LEDs 403. In one embodiment, the LEDs 403 are wired in series using connecting wires 404. A pair of electrical conducting wires 440, 442 supply power to the series-wired LEDs 403 from a standard threaded base portion 411 of the lighting device 400. An electronic driver inside the base 411 provides power to the LEDs. The frame 424 can be constructed as described with respect to the frame elements of the embodiments referred to above—i.e., the frame can be solid or hollow. In an alternative embodiment, the frame 424 includes a first or upper surface 451 and a second or lower surface 452 and a plurality of heat dissipating fins 453 disposed between the two surfaces.

A heat conduction pipe 405 extends substantially along a central axis of the lighting device 400 and includes a proximal end 420 and a distal end 422. The frame 424 is secured to the proximal end 420 of the heat conduction pipe 405 in a manner similar to that described above with the previous embodiments. Likewise, the distal end 422 of the heat conduction pipe 405 extends into a heat sink 408 that is constructed and positioned similar to that described above with the previous embodiments. The various embodiments of the heat conducting pipe and heat sink discussed above, including the means of cooling the same, apply equally to the embodiments described above. Further, it is noted that the various embodiments concerning the use of surface mounted LEDs and LED chips, including the manner of wiring in series or parallel, the optional use of phosphors or epoxy coverings and the optional use of a cooling fan, may all be used with or incorporated into the embodiments depicted in FIG. 7.

The LED devices or LED chips used to construct the lighting devices described above may emit single or multiple colors or white color. The bulbs or encapsulating cover can also be frosted or clear or coated with phosphor to convert the light from LED to different colors as required. While certain embodiments and details have been included herein and in the attached invention disclosure for purposes of illustrating the invention, it will be apparent to those skilled in the art that various changes in the methods and apparatuses disclosed herein may be made without departing from the scope of the invention, which is defined in the appended claims.

What is claimed is:

1. A lighting device, comprising:

a frame;

a face portion located on the frame, the face portion having a face area;

a panel coupled to the face portion, the panel having a panel area that is substantially equal to the face area;

a LED source of light mounted on said panel;

a heat sink spaced from said frame to position the plurality of LED sources of light at least one inch away from said heat sink;

a heat conducting pipe having a proximal end and a distal end, said proximal end connected to said frame and said distal end connected to said heat sink;

an electronic driver positioned proximate said heat sink and configured to connect to an external source of power; and first and second electric conducting wires connecting said electronic driver to said plurality of LED light sources.

2. The lighting device of claim 1, further comprising a transparent housing.

3. The lighting device of claim 2, wherein said electrical connection to an external source of power comprises an Edison screw base.

4. The lighting device of claim 1, wherein the plurality of LED light sources comprises a plurality of surfaced mount LEDs.

5. The lighting device of claim 1, wherein the plurality of LED light sources comprises a plurality of LED chips.

6. The lighting device of claim 1, wherein the frame has six faces and a hexagonal cross section, and wherein an LED source of light is positioned on each face.

7. The lighting device of c1aim 1, wherein the frame is multifaceted in both a longitudinal and latitudinal direction, and wherein an LED source of light is positioned on each face of said multifaceted frame.

8. The lighting device of claim 1, wherein the heat conduction tube comprises an outer tube, a wicking material and a working fluid.

9. The lighting device of claim 1, wherein the heat conducting tube is constructed of a first material and includes an inner material having a melting temperature lower than the melting temperature of the first material.

10. The lighting device of claim 9, wherein the first material is copper and the inner material is gallium.

11. The lighting device of claim 1, wherein the heat sink includes a plurality of heat dissipating members and wherein the heat sink is constructed of aluminum.

12. The lighting device of claim 11, wherein the heat dissipating members are fins.

13. The lighting device of claim 11, wherein the heat dissipating members are rods.

14. The lighting device of claim 1, wherein the frame is constructed of a solid non-hollow piece of metal.

15. The lighting device of claim 1, wherein the frame is hollow and constructed of metal.

16. A lighting device, comprising:

a multifaceted heat conducting frame having a plurality of faces:

a plurality of face portions located on the frame, each face portion having a face area;

a plurality of panels coupled to, and corresponding to, the plurality of face portions, each of the plurality of panels having a panel area that is substantially equal to the face area of each corresponding face portion;

a plurality of LED sources of light mounted, an LED source of light being mounted on each of said plurality of panels;

a heat sink spaced from said frame to position the plurality of LED sources of light at least one inch away from said heat sink;

a heat conducting pipe having a proximal end and a distal end, said proximal end connected to said frame and said distal end connected to said heat sink;

an electronic driver positioned proximate said heat sink and configured to connect to an external source of power;

an electrical conductor connecting said electrical connection to said plurality of LED light sources and the electronic driver; and a housing.

17. The lighting device of claim 16, wherein said electrical connection to an external source of power comprises an Edison screw base.

18. The lighting device of claim 16, wherein the plurality of LED light sources comprises a plurality of surfaced mount LEDs.

19. The lighting device of claim 16, wherein the plurality of LED light sources comprises a plurality of LED chips.

20. The lighting device of claim 16, wherein the heat sink includes a plurality of heat dissipating members and wherein the heat sink is constructed of aluminum.

21. A lighting device, comprising:

a multifaceted heat conducting frame having a plurality of faces;

a plurality of face portions located on the frame, each face portion having a face area;

a plurality of panels coupled to, and corresponding to, the plurality of face portions, each of the plurality of panels having a panel area that is substantially equal to the face area of each corresponding face portion;

a plurality of LED chip sources of light mounted, an LED chip source of light being mounted on each of said plurality of panels;

a heat sink spaced from said frame to position the plurality of LED sources of light at least one inch away from said heat sink, said heat sink including a plurality of heat dissipating members and constructed of aluminum;

a heat conducting pipe having a proximal end and a distal end, said proximal end connected to said frame and said distal end connected to said heat sink;

an electronic driver positioned within an Edison screw base that is positioned proximate said heat sink and configured to connect to an external source of power;

an electrical conductor connecting said electronic driver to said plurality of LED light sources; and a housing.

22. A lighting device, comprising:

a frame;

a face portion located on the frame, the face portion having a face area;

a panel coupled to the face portion, the panel having a panel area that is substantially equal to the face area;

a LED source of light mounted on said panel, said LED sources operable to directly receive AC power input;

a heat sink spaced from said frame to position the plurality of LED sources of light at least one inch away from said heat sink;

a heat conducting pipe having a proximal end and a distal end, said proximal end connected to said frame and said distal end connected to said heat sink;

a connection base positioned proximate said heat sink and configured to connect to an external source of power; and first and second electric conducting wires connecting said connection base to said plurality of LED light sources.

* * * * *